US006713430B2

(12) United States Patent
Tominaga et al.

(10) Patent No.: US 6,713,430 B2
(45) Date of Patent: Mar. 30, 2004

(54) PRINTED MATTER

(75) Inventors: Nakao Tominaga, Sakurai (JP); Yoshinori Murata, Kyoto (JP)

(73) Assignee: Sakura Color Products Corporation (JP)

( * ) Notice: Subject to any disclaimer, the term of this patent is extended or adjusted under 35 U.S.C. 154(b) by 0 days.

(21) Appl. No.: 09/829,135

(22) Filed: Apr. 9, 2001

(65) Prior Publication Data

US 2001/0031702 A1 Oct. 18, 2001

(51) Int. Cl.[7] ..... B41M 5/30
(52) U.S. Cl. ..... 503/201; 503/204; 503/226
(58) Field of Search ..... 503/201, 226, 503/204

(56) References Cited

U.S. PATENT DOCUMENTS 5,158,924 A * 10/1992 Konagaya et al. ..... 503/201
5,193,854 A * 3/1993 Borowski et al. ..... 283/87
6,313,067 B1 11/2001 Maruyama ..... 503/227

* cited by examiner

*Primary Examiner*—Bruce H. Hess
(74) *Attorney, Agent, or Firm*—Wood, Phillips, Katz, Clark & Mortimer

(57) ABSTRACT

A leaf of printed matter has a metachromatic image 2 printed with an ink thermally changing its color and a non-metachromatic image 3 of a colorant not changing its color. A principal figure 5 is formed of the colorant, and a background 6 is formed with the metachromatic ink. The printed matter 1 may be used to transfer its images to a cup 10. The ink of the background scene 6 in the outer layer will turn to colorless within a prescribed range of temperatures, rendering visible only the central principal figure 5. At lower temperatures, the metachromatic ink will restore its color to cause the background for instance a snowy scene to appear, thus affording a novel and fantastic visual effect.

21 Claims, 13 Drawing Sheets

BEFORE

AFTER

BEFORE

AFTER

BEFORE

AFTER

"H" is a registered trademark of Honda Mortor Co., Ltd.

"NISSAN" and "Sunny" are registered trademarks of NISSAN MOTOR CO., LTD.

PRINTED MATTER

FIELD OF THE INVENTION

The present invention relates to reversibly metachromatic printed matter prone to change in color in response to temperature change. The printed matter of the invention will be used preferably as transfer paper sheets or as decorative seals.

BACKGROUND OF THE INVENTION

There are known in the art some kinds of printed matter prepared using (a) metachromatic ink(s) such that characters and/or figures will appear on them at prescribed temperatures (see for example the Japanese Utility Model Publications No. Hei.4-6938 and No. Hei.4-6939).

Each of such printed matter comprises an underlayer of a non-metachromatic ink (viz., an ordinary ink) applied to a substrate so as to provide any desired characters and/or figures. An upper layer covering the non-metachromatic under-layer is composed of a thermally metachromatic ink so that any superimposed image will lose or restore its color in response to change in temperature. The whole surface area of such a non-metachromatic printed image is completely covered with the metachromatic image in the prior art printed matter.

At room temperature or moderate temperatures, the colored meta-chromatic print hides the non-metachromatic print, whereby such a prior art printed matter sheet will be observed as if it were an entirely monochromatic sheet. However at predetermined temperatures, the metachromatic printed image in the upper layer of the printed matter will become colorless, thus rendering visible the underlying non-metachromatic printed image such as characters.

SUMMARY OF THE INVENTION

As discussed above, those prior art printed matter sheets have been printed with such a thermally metachromatic ink covering the entirety of non-metachromatic printed image. Therefore, characters and the like have been allowed to appear in a normal solid-color surface, in a simple manner failing to afford any peculiar or ornamental effect.

An object of the present invention is to provide a novel type of printed matter that can produce a more fantastic visual effect in use.

Each surface of the printed matter of the invention is composed of a first image printed with at least one of first thermo-metachromatic colorants prone to reversible change in color due to change in ambient temperature, and a second image printed either with a non-metachromatic colorant or with at least one of second thermo-metachromatic colorants prone to change in color at temperatures different from those at which the first colorants will change their color. The first and second images proposed herein may be printed on respective discrete regions in the printed matter surface.

In this invention, the concept of 'reversible change in color in response to ambient temperature' as summarized above does include color change between chromatic colors such as red and yellow, color change between a chromatic color and an achromatic color for example between red and white, and color change between any chromatic or achromatic color and transparency for example between red and transparency.

The term 'printed images' used herein include characters, letters, figures and the like.

As mentioned above, the thermally metachromatic image and the thermally non-metachromatic image may be printed on the discrete regions in the printed matter of the invention. This means that the latter image will be sensed irrespective of any change in temperature so as to provide a basic pattern to which the former metachromatic image is added at prescribed temperatures.

In another mode of carrying out the present invention, either the first or second printed image may occupy an almost entire region of the printed matter surface, and correspondingly either the second or first image occupies at least one portion of the remainder region so as to serve as a background image or scene.

Thus, either of the printed images is disposed fully over the entire surface, to be accompanied by the background that is formed with the other printed image capable of producing various scenes such as a summer scene, a winter scene or any other designed scene.

In still another mode, the first and second printed images may be line drawings that are of the same configuration at least in part and overlap one another at least in part.

Such a composite image consisting of the line drawings overlapping one another at least partially will not greatly change its pattern but will merely change its color.

In a further mode, the first printed image may be superimposed on the second non-metachromatic image so as to expose a part thereof.

This type of the printed matter comprises the metachromatic image formed with a metachromatic colorant reversibly changeable between its colorless state and its colored state.

In contrast with the prior art overlying thermo-metachromatic image completely covering the underlayer, the overlying metachromatic layer in this invention does hide only in part the non-thermo-metachromatic underlayer image. Therefore, a curious impulse will come over any viewer of this printed matter, wondering what is a hidden part of that image underlying the surface layer.

In a still further mode, the first printed image may be superimposed on the second printed image of a meaning relevant to the first one.

Such a non-metachromatic and metachromatic images in the printed matter of the invention are of supplementary meanings to give viewers an intellectual impression or a feeling of curiosity.

The first image may be formed of any thermo-metachromatic colorant that reversibly changes in color depending on ambient temperature, from its colorless state to its colored state or vice versa.

If the second image is formed of at least one of second thermo-metachromatic colorants prone to change in color at temperatures different from those at which the first colorants will change their color, the second thermo-metachromatic colorant may be one that reversibly changes in color depending on ambient temperature, from its colorless state to its colored state or vice versa.

The printed matter summarized above may be used as transfer sheets or as seals, and the first printed image may be a polychromatic image of two or more colors.

BRIEF DESCRIPTION OF THE DRAWINGS

FIG. 2(*b*) is a front elevation of the printed matter example prepared in the first embodiment but has undergone change in temperature;

FIG. 3(*b*) is a front elevation of the further printed matter example prepared in the first embodiment but has undergone change in temperature;

FIG. 6(*b*) is a front elevation of the printed matter example prepared in the second embodiment but has undergone change in temperature;

FIG. 8(*b*) is a front elevation of the printed matter example prepared in the third embodiment but has undergone change in temperature;

FIG. 10(*b*) is a front elevation of the printed matter example prepared in the fourth embodiment but has undergone change in temperature;

FIG. 13(*b*) is a front elevation of the printed matter example prepared in the fifth embodiment but has undergone change in temperature.

THE PREFERRED EMBODIMENTS OF THE INVENTION

<First Embodiment>

Figure 1:
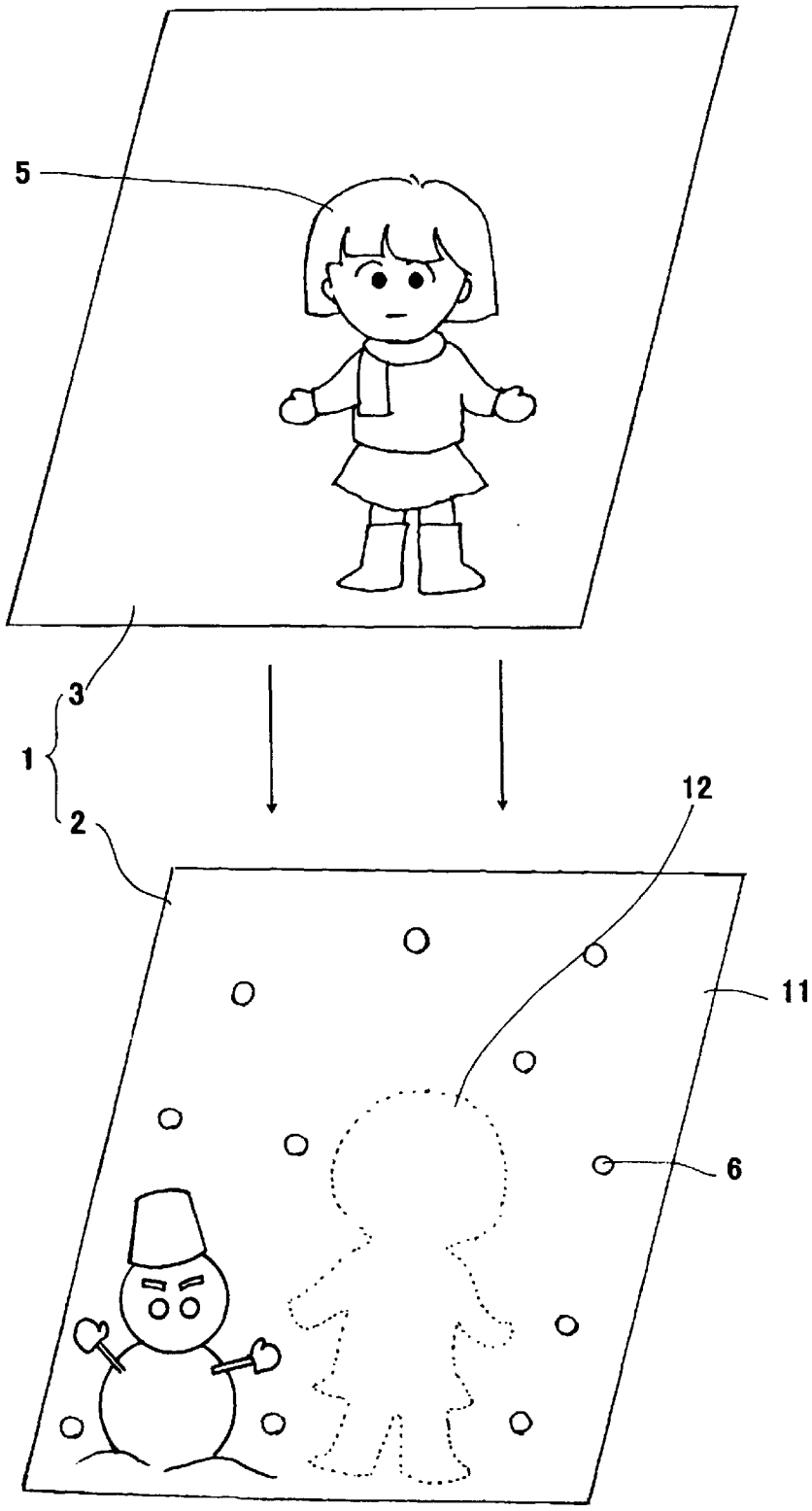
FIG. 1 is a perspective scheme of printed matter provided in a first embodiment of the present invention.

Now, the first embodiment will be described referring to FIGS. 1 to 4.

At first, the elementary construction of the first embodiment will be described referring to FIGS. 1 and 4. Each leaf of printed matter 1 in this embodiment has a printed image 2 formed of a thermo-metachromatic ink (as a metachromatic colorant) and a further printed image 3 formed of a non-metachromatic colorant. A principal figure 5 is printed with the non-metachromatic colorant, with a background scene 6 being printed with the thermo-metachromatic ink.

Figure 5:
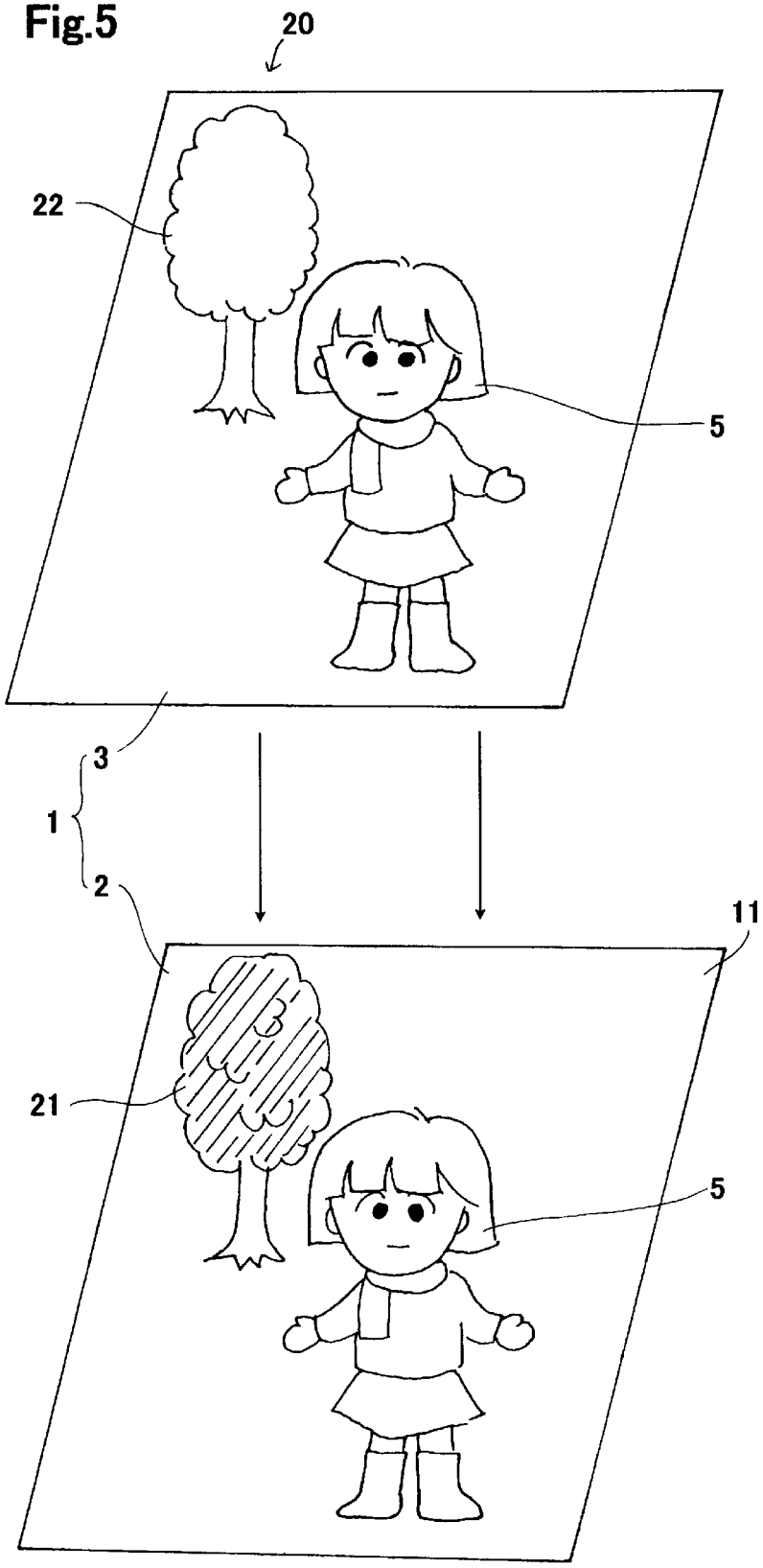
FIG. 5 is a perspective scheme of printed matter provided in a second embodiment of the present invention.

In other words, the principal figure 5 in the printed leaf is composed of the non-metachromatic ink and all the remainder regions other than this figure 5 are composed of the thermo-metachromatic ink.

Figure 4:
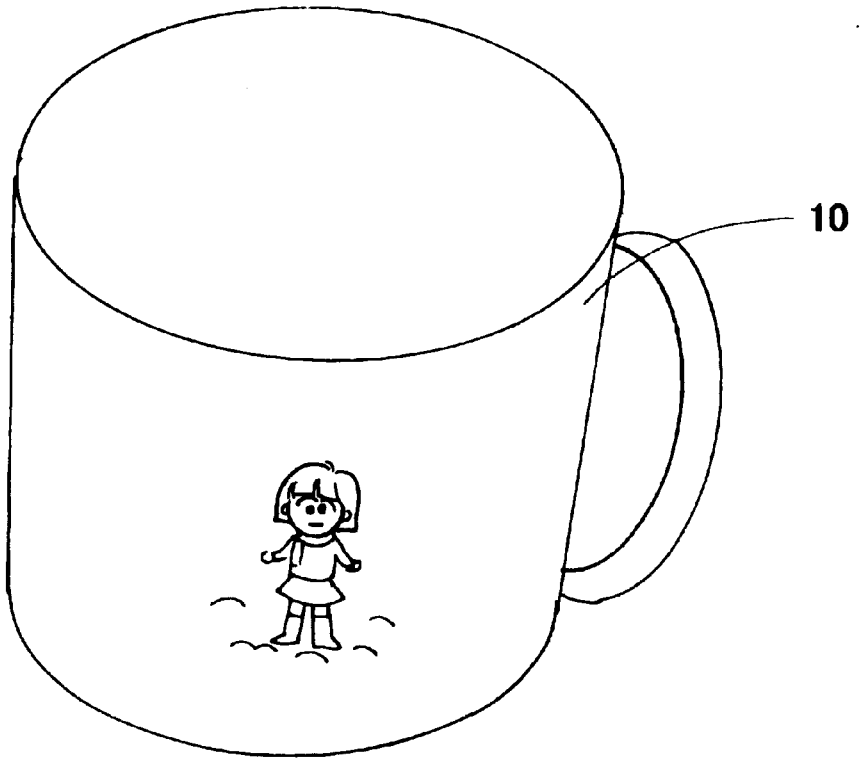
FIG. 4 is a perspective view of a cup on which the printed matter of the first embodiment has been stuck.

The printed matter 1 may for example be a transfer sheet whose prints will be transferred in use for instance to an article such as a cup 10 or the like shown in FIG. 4. The transferred images on the cup 10 are reversed inside out.

The printed matter 1 comprises a plastics film 11 as a substrate, and the thermo-metachromatic image 2 as a first layer is printed on this substrate. Subsequently, the non-thermo-metachromatic image 3 as a second layer is printed on the first layer.

The terms 'first layer' and 'second layer' are used here only for brief and simple description. The first thermo-metachromatic colorant layer has no portion overlapping the second non-metachromatic colorant layer, but both the layers are arranged side by side on a common plane.

The metachromatic image 2 of the first layer is a print of a thermo-metachromatic ink that will reversibly change its state from 'colorless' to 'colored' or vice versa above or below a prescribed temperature. An example of such a metachromatic ink is a colorant whose main ingredient is a combination of a compound serving as an electron donor and a mating compound serving as an electron acceptor. The donor is a coloring agent and the acceptor is a developing agent acting thereon. A printing ink included in this type of the thermo-metachromatic colorants is disclosed in the Japanese Patent Publication No. 52-7764. Similar thermo-metachromatic colorants will be found in ibid. No. 51-35216, ibid. 51-35414 and ibid. 51-44708.

Those inks may have any desired hue such as red, blue, yellow, green, orange, violet or any sophisticated color between them, based on blend ratio of the inks. It is convenient to the invention that they will reversibly lose or restore their hue within a considerable wide range of temperatures.

Such a thermo-metachromatic colorant may be prepared in the form of a printing ink that will then applied to the whole surface of plastics film 11 or spotted thereto to form the metachromatic layer.

In the embodiment of FIG. 1, the first layer of the metachromatic print 2 presents a snowing scene as the background 6, all over the surface except for the principal figure 5.

The non-metachromatic print 3 as the second layer is formed of any of ordinary types of printing inks for wide uses, by the conventional printing method.

A generally central region 12 devoid of the metachromatic printed image 2 is, in the embodiment of FIG. 1, printed with the ordinary printing ink to give the principal figure 5.

The printed matter 1 in this embodiment has the non-metacromatic image consisting only of the main figure 5.

As noted above, this printed matter 1 will be used to transfer its printed images onto the cup.

After transfer of the images, the surface metachromatic ink forming the background 6 will become or remain colorless within a prescribed range of temperatures, making only the central figure 5 visible to observers of the cup. If however ambient atmosphere becomes colder than a lower temperature limit, then the metachromatic ink will become colored to thereby allow the snowing background 6 to appear.

Figure 2A:
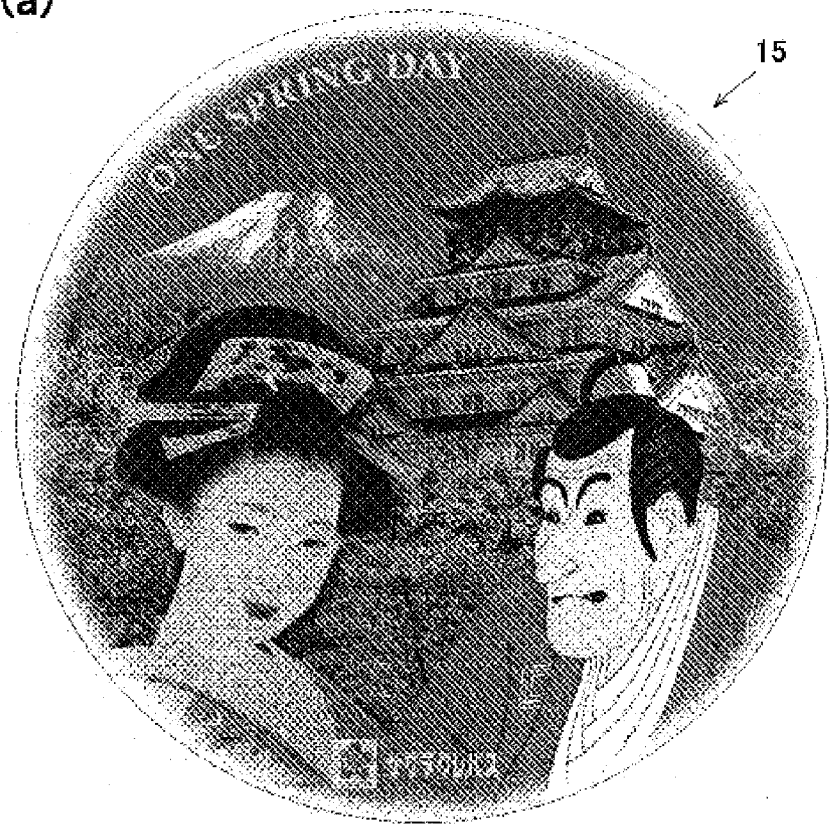
FIG. 2(*a*) is a front elevation of an example of the printed matter that is prepared in the first embodiment but has not undergone yet any change in temperature.
Figure 2B:
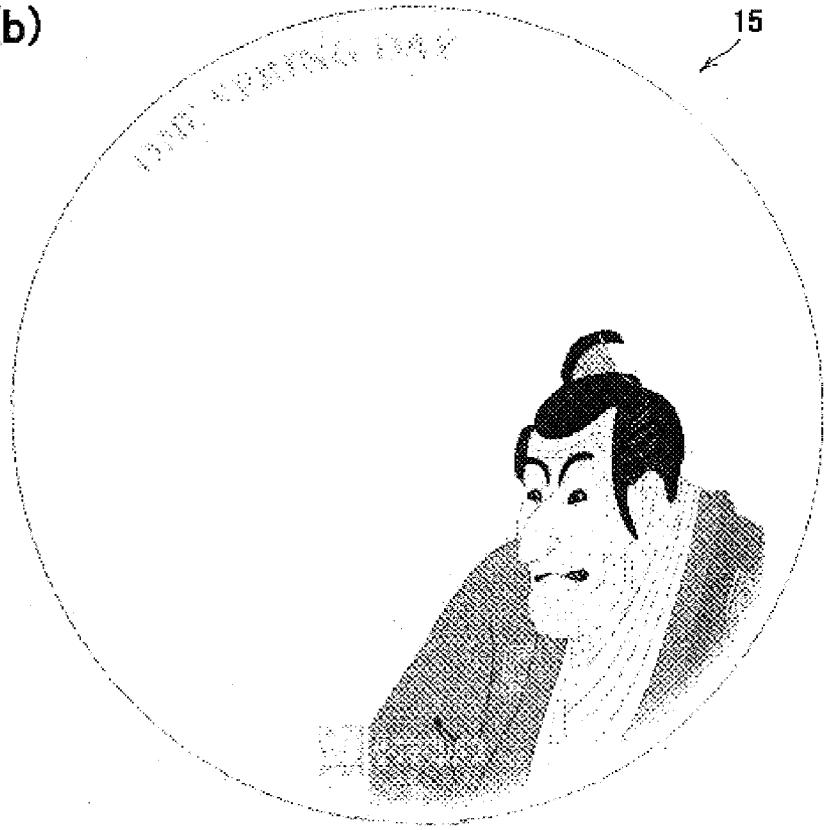

FIGS. 2(*a*) and 2(*b*) show a virtual example 15 of the embodiment, wherein the known deformation portrait drawn by the Japanese painter 'Sharaku' is printed to a lower right-hand region with use of a non-metachromatic regular ink. The background composed of a Japanese castle, the Mount Fuji, a Japanese classic dancer girl 'Maiko' and cherry blossoms is printed with a thermo-metachromatic ink.

In the printed matter shown in FIGS. 2(*a*) and 2(*b*), both the deformation portrait as the second layer and the background scene including the castle and so on as the first layer are multicolored. The portrait is a full-color print formed of the non-metachromatic ink containing four colorants whose hues are blue, red, yellow and black. Likewise, the background scene is a print of the metachromatic ink also containing four colorants: blue, red, yellow and black. In detail, Mount Fuji is printed white, the sky is blue, the 'Maiko' has black hair, beige skin, yellow hair-ornaments, red lips and wears a Japanese classic dress 'kimono' colored pale-blue and bluish-yellow.

The printed matter shown in FIGS. 2(*a*) and 2(*b*) will stand fully-drawn in its normal state, unless its background scene surrounding 'Sharaku' and composed of the castle and so on does disappear in response to change in temperature into a predetermined range.

Figure 3A:
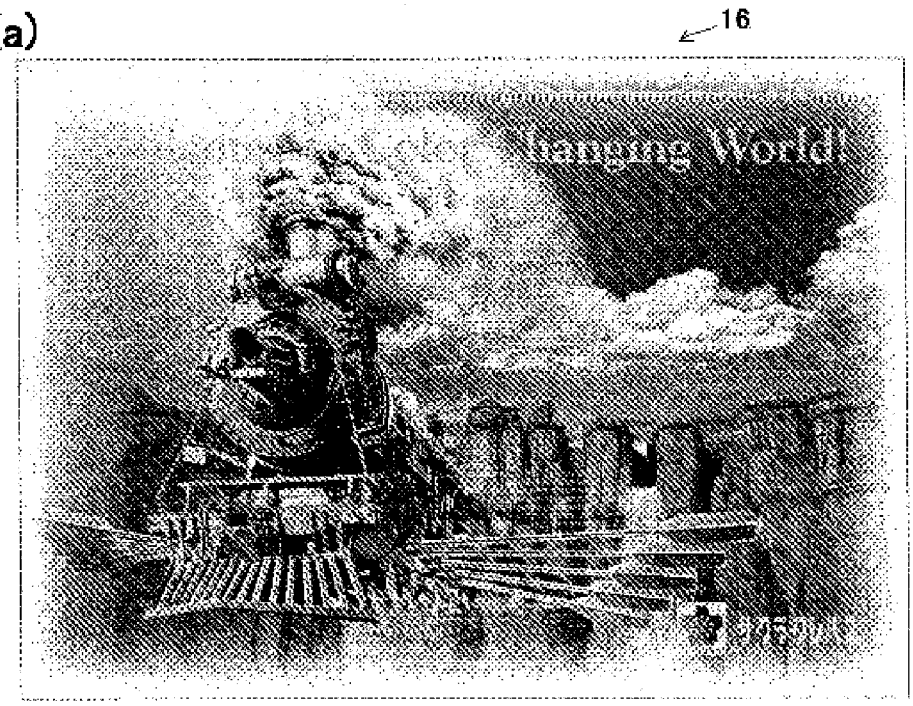
FIG. 3(*a*) is a front elevation of a further example of the printed matter that is prepared in the first embodiment but has not undergone yet any change in temperature.
Figure 3B:
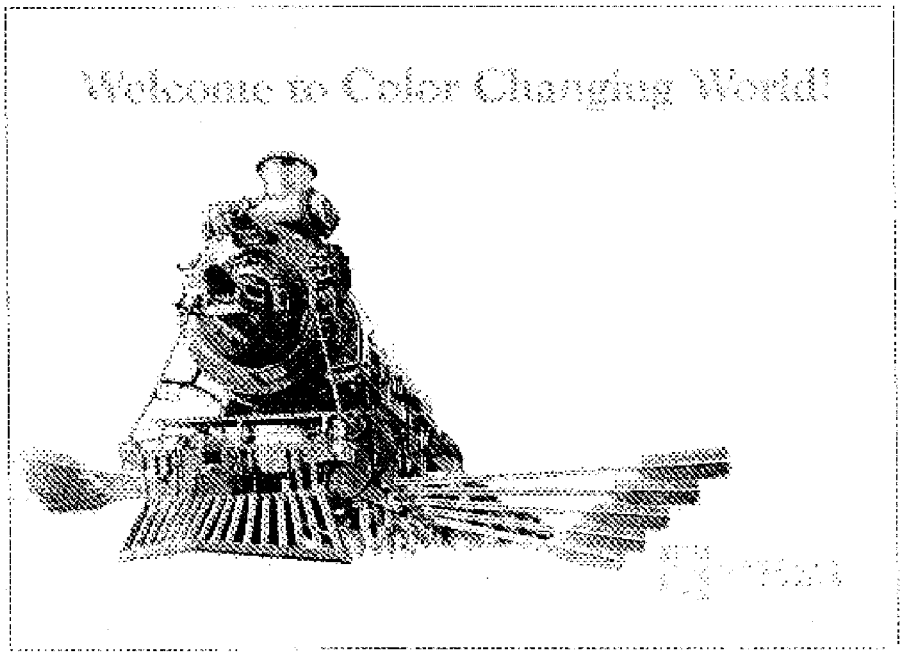

FIGS. 3(*a*) and 3(*b*) illustrate another virtual example 16 of the printed matter, wherein the second layer is a print of a locomotive and the first layer is a print of the Grand Canyon in the U.S.A. This composite picture will also stand fully-drawn in its normal state, unless its background scene of the Grand Canyon disappears in response to temperature shift into a predetermined range.

<Second Embodiment>

Next, the second embodiment will be described referring to FIGS. 5 to 6(*b*).

A metachromatic print and a non-metachromatic print in the printed matter of this embodiment shown in FIG. 5 do overlap one another, whereas those prints in the first embodiment occupy discrete regions.

As seen in FIG. 5, the printed matter 20 has a first layer that is formed of a thermo-metachromatic ink giving a girl's figure as a principal image 5 and also providing the image of a tree 21 as an exemplary background scene.

A second layer of this printed matter is also composed of the principal image 5 and another image of the tree 22 that is of the same shape and disposed at the same position as that 21 in the first layer. Thus, two images of the tree are superimposed one on another though color of the tree image 22 is different from the developed color of the other tree image 21.

Also in this embodiment, both the first and second layers of the printed matter 20 are full-color prints.

Those prints in this printed matter 20 are formed on a plastics film 11, as in the first embodiment. The metachromatic ink for the first layer is applied first to the film 11, and then the non-metachromatic ink for the second layer is superimposed.

Similarly, this printed matter 20 may be used to transfer its prints to a cup.

These print layers will thus be reversed inside out on the surface of the cup so that the non-metachromatic print 3 underlies the metachromatic print 2 exposed newly.

Within a prescribed range of temperatures, the images of tree 21 and girl will remain colorless in the first layer of printed matter 20 so that only the main figure 5 and the background tree 22 are visible in the second layer. However at other temperatures for instance considerably elevated temperatures, the metachromatic ink of the first layer will become colored to cause the tree image 21 in this layer to hide that 22 in the second layer. Since those tree images are of the same configuration and size but merely different in their colors, viewers would feel as if that tree had altered its color depending on ambient temperature.

Figure 6A:
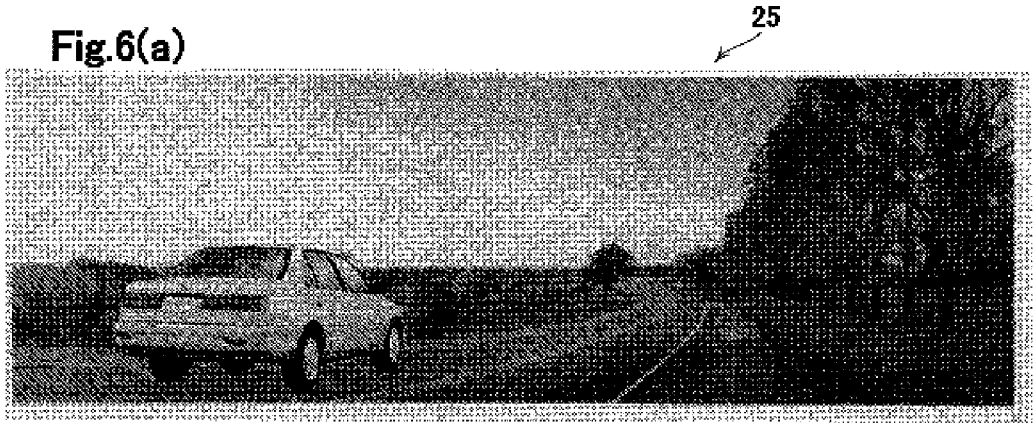
FIG. 6(*a*) is a front elevation of an example of the printed matter that is prepared in the second embodiment but has not undergone yet any change in temperature.
Figure 6B:
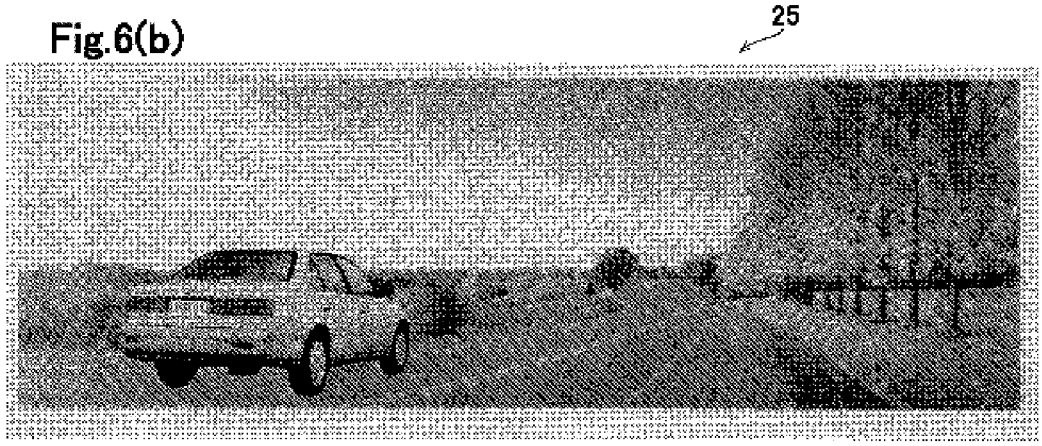

A leaf of printed matter 25 shown in FIGS. 6(*a*) and 6(*b*) is a virtual example of the second embodiment. An automobile is printed with a non-metachromatic ink, and the scope of background such as a road is a print of a metachromatic ink. Two prints, of which one is metachromatic and the other is non-metachromatic, are thus superimposed one on another.

Therefore, at elevated temperatures, the metachromatic ink of the first layer will become colored and visible to thereby hide the road and so on in the second layer. Since those background images are of the same configuration and size but merely different in their colors, viewers would feel as if the ambient temperature had caused that road to change in color and as if the season had changed.

<Third Embodiment>

Figure 7:
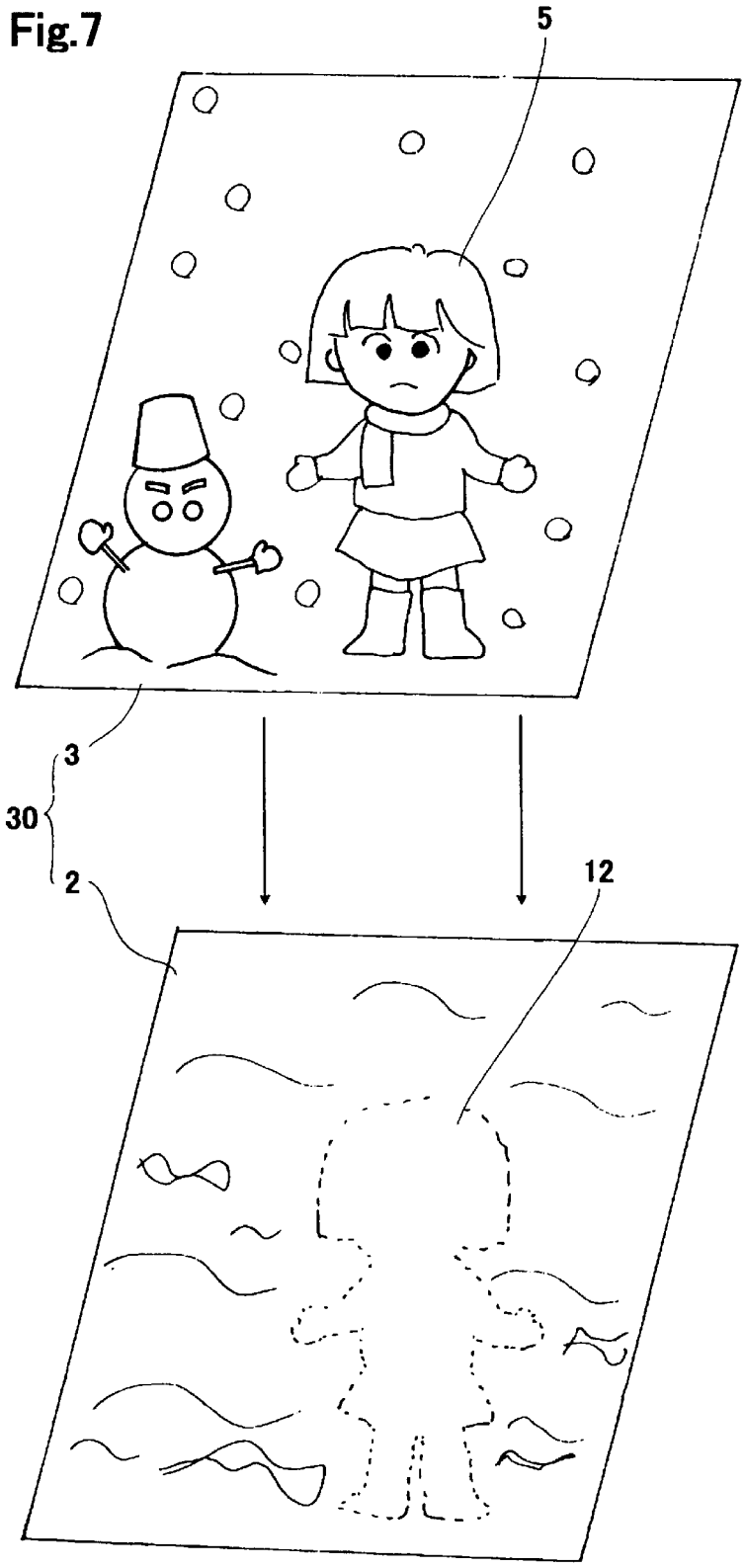
FIG. 7 is a perspective scheme of printed matter provided in a third embodiment of the present invention.

Printed matter in accordance with the third embodiment will be described referring to FIGS. 7 to 8(*b*).

A metachromatic print 2 in the first layer of this printed matter 30 expresses water waves that will cause viewers to imagine the summer season around a portrait, which will appear under certain conditions.

On the other hand, a non-metachromatic print 3 as the second layer contains the portrait of a girl as the main or principal figure 5, in addition to a landscape of snow representing the winter season. The principal figure 5 and its background printed in the second layer do cover the whole surface thereof.

The first layer in this printed matter 30 does however overlap such a background in the second layer either partly or fully.

The leaf of printed matter 30 may also be a transfer sheet having a plastics film 11 serving as the substrate thereof. Its stratum structure will be inverted when transferred to a cup 10 or the like such that its internal first layer will become the external layer in the transferred image.

Within a prescribed range of temperatures, the metachromatic ink forming the background waves will remain colorless in the printed matter 30 so that only the main figure 5 and the background landscape of snow are visible in the second layer. However at other temperatures for instance considerably elevated temperatures, the metachromatic ink will restore its color to hide that snowy landscape in the second layer.

Figure 8A:
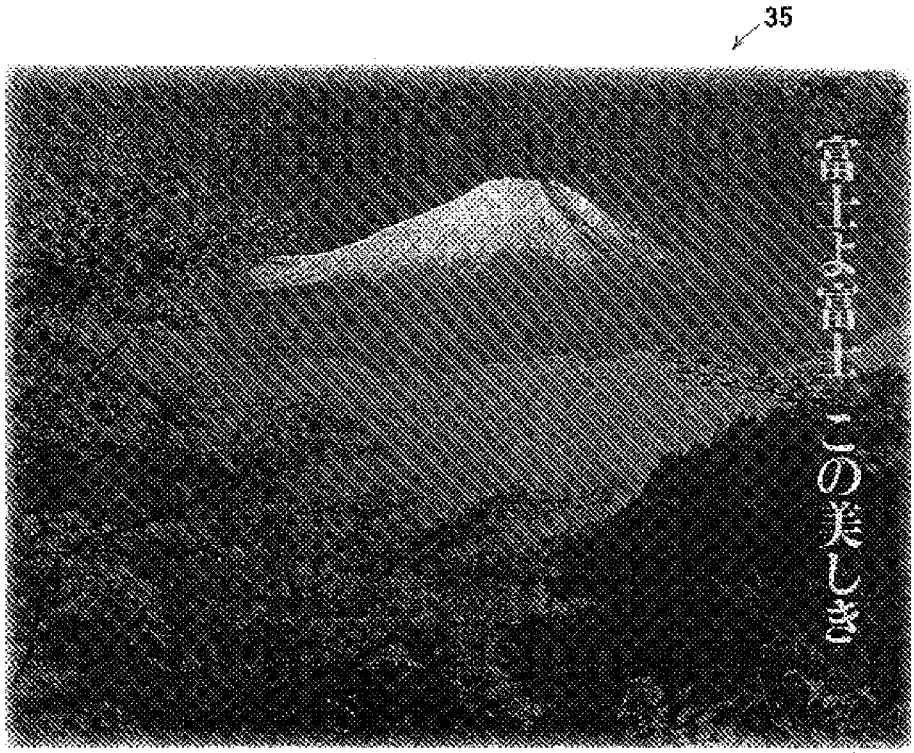
FIG. 8(*a*) is a front elevation of an example of the printed matter that is prepared in the third embodiment but has not undergone yet any change in temperature.
Figure 8B:
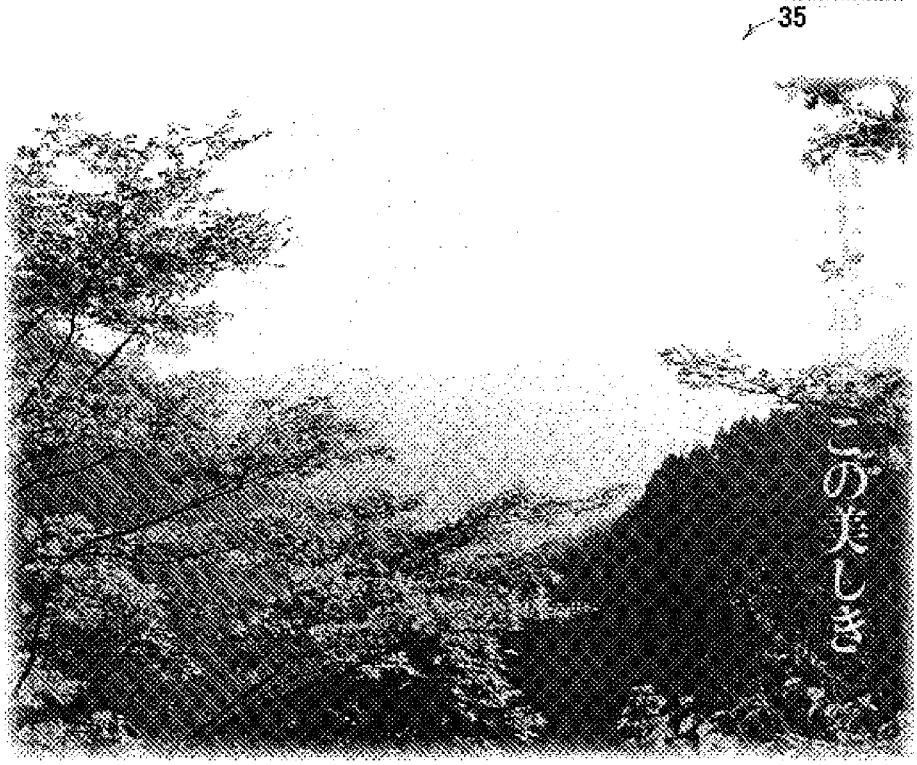

In the printed matter 35 shown in FIGS. 8(*a*) and 8(*b*) as a virtual example of the third embodiment, the Mount Fuji and its surroundings are printed with the non-metachromatic ink, with a hazy landscape of them being printed with the metachromatic ink.

Both the first and second layers of this printed matter 35 are likewise full-color prints.

At elevated temperatures, the metachromatic ink will be colored to cause the hazy landscape to appear.

<Fourth Embodiment>

Figure 9:
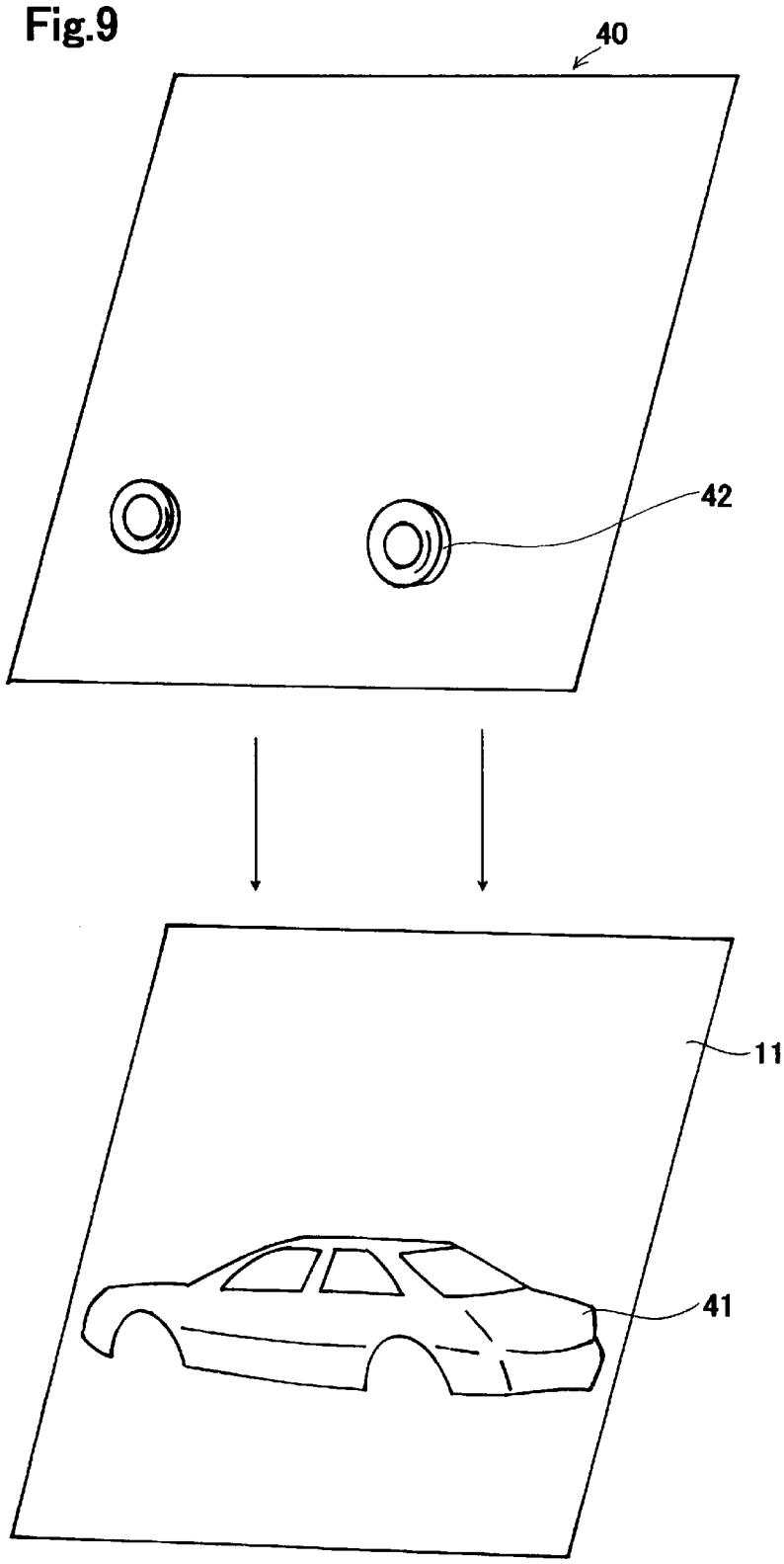
FIG. 9 is a perspective scheme of printed matter provided in a fourth embodiment of the present invention.

Now, the forth embodiment will be described with reference to FIGS. 9 to 10(*b*).

A leaf of printed matter 40 of this embodiment has a first layer to which the image of an automobile 41 without tires is printed.

The image of tires 42 is printed on a second layer to coincide with the automobile image 41.

The printed matter 40 having also a plastics base film may be a transfer sheet. After transfer of those image prints to a cup 10 or the like, said layers are reversed inside out to expose the first layer.

Within a prescribed range of temperatures, the first layer will stand effective to partially hide the image of tires 42 of the second layer in the printed matter 40 so that an automobile image with tires 42 is visible. However at other temperatures for instance considerably elevated temperatures, the metachromatic colorant will lose its color to render visible only the entire image of tires 42 of the second layer.

The printed matter of this embodiment is of a feature that a certain change in temperature causes one image to be replaced with the other image wherein these images are relevant to each other. Such a quiz-like feature will inspire intellectual interest in viewers. Other examples of relevancy between images will include: relationship between a finished product and its parts, relationship between the name of a corporate and its products; relationship between some animals or plants of similar behaviors or similar species, relationship between a selected person and his or her nickname, and relationship between the person and any article for use in his or her peculiar performance.

Figure 10A:
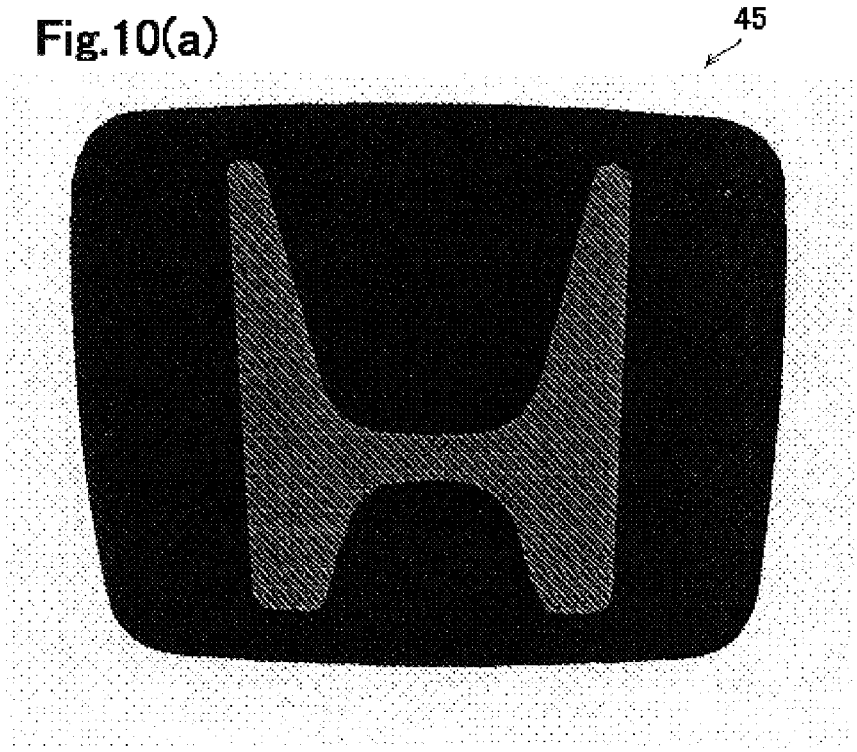
FIG. 10(*a*) is a front elevation of an example of the printed matter that is prepared in the fourth embodiment but has not undergone yet any change in temperature.
Figure 10B:
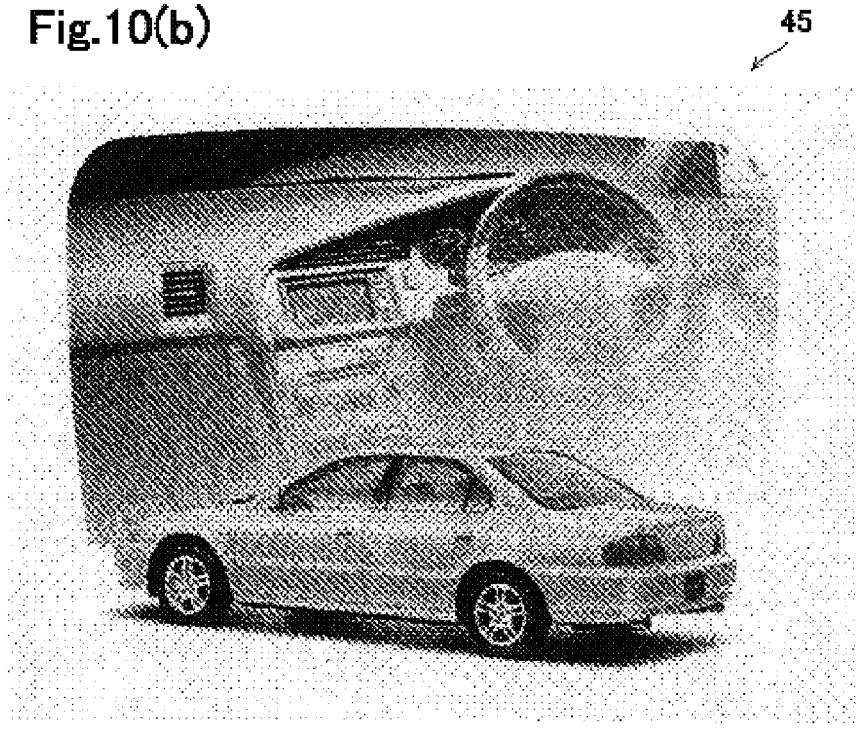

FIGS. 10(*a*) and 10(*b*) show a virtual example of the fourth embodiment, wherein the external appearance and the interior of an automobile are printed with a non-chromatic ink to provide a basic image. The logotype 'H' as the corporate name and registered trademark of the Honda Motor Co., Ltd., a Japanese company, is also printed to completely overlap the basic image.

The logotype 'H' is colored blue and surrounded by a black background.

The metachromatic ink forming the first layer in this printed matter 45 will remain colored within a range of ordinary temperatures so as to hide the second layer having therein the image of the automobile. At elevated temperatures, that ink will lose color to become transparent so as to render the automobile image visible. Such replacement of one image with the other one intimately relevant thereto in the printed matter of this embodiment will give viewers a quiz-like interest.

<Fifth Embodiment>

Figure 11:
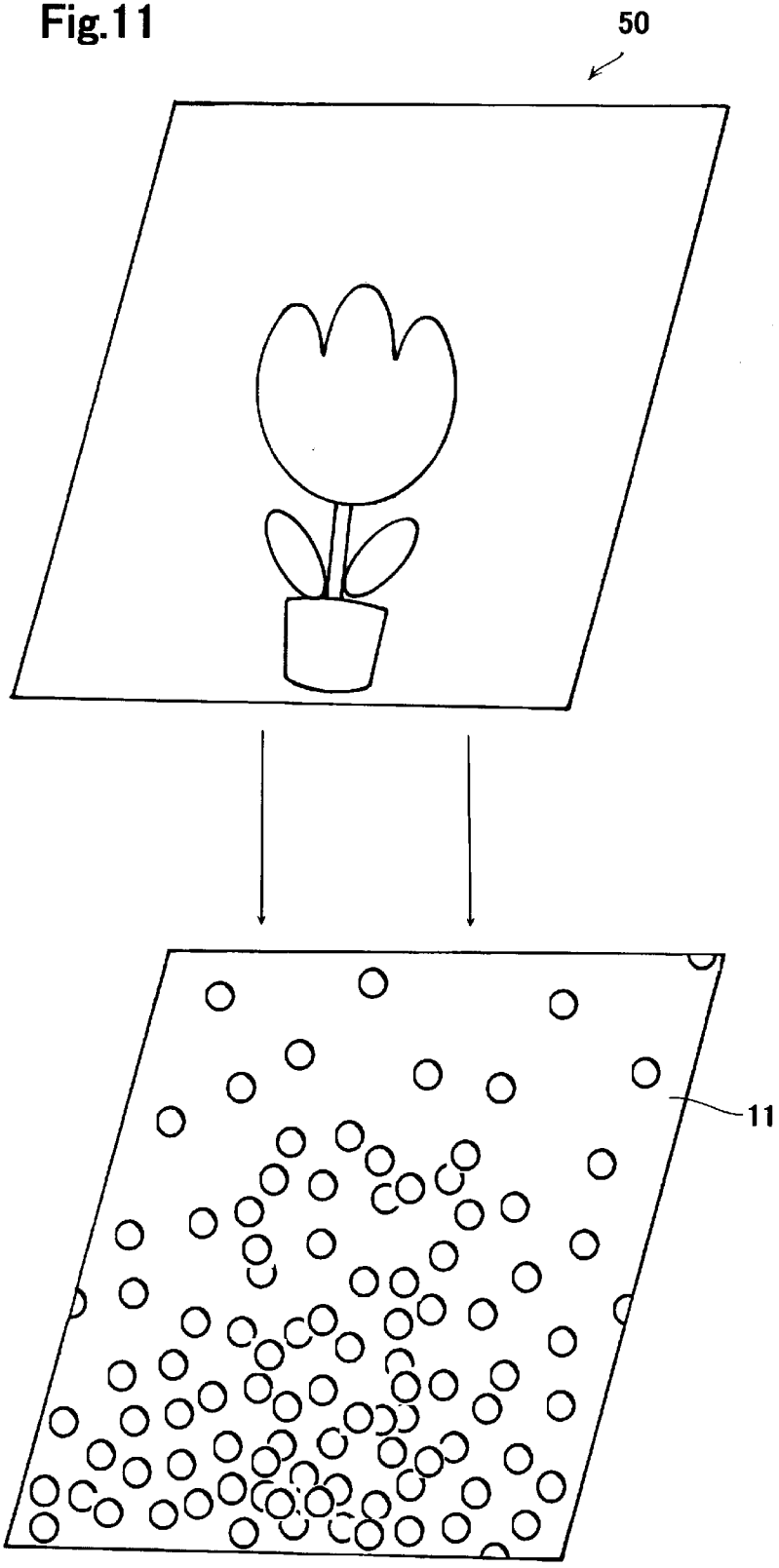
FIG. 11 is a perspective scheme of printed matter provided in a fifth embodiment of the present invention.
Figure 12:
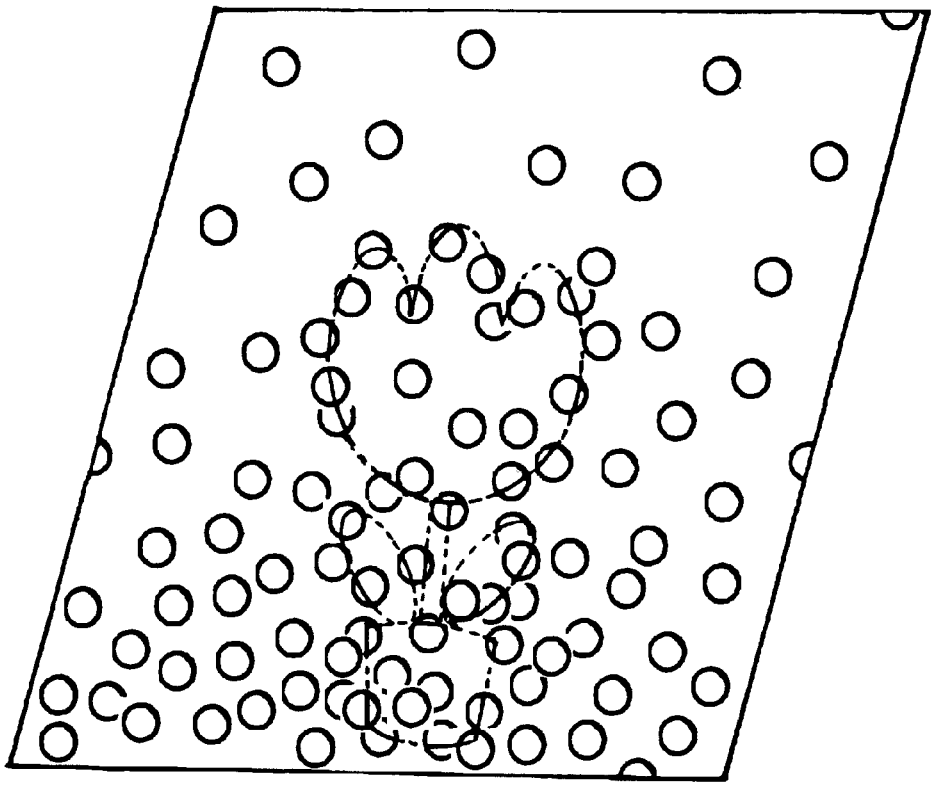
FIG. 12 is a perspective view of the printed matter elements prepared in the fifth embodiment and overlaid one on another.
Figure 13A:
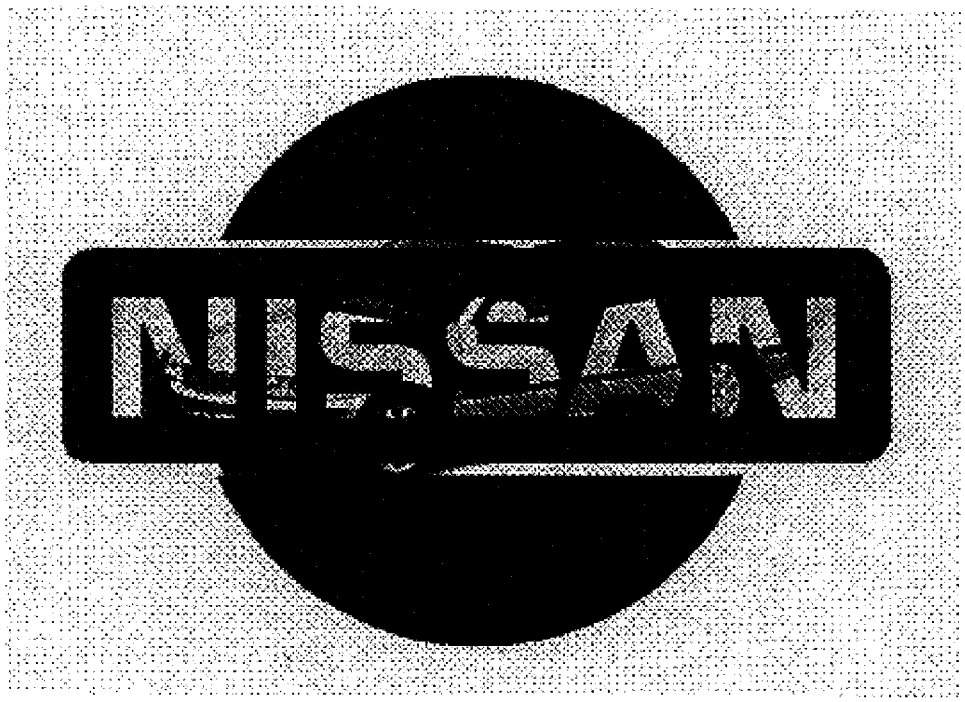
FIG. 13(*a*) is a front elevation of an example of the printed matter that is prepared in the fifth embodiment but has not undergone yet any change in temperature.
Figure 13B:
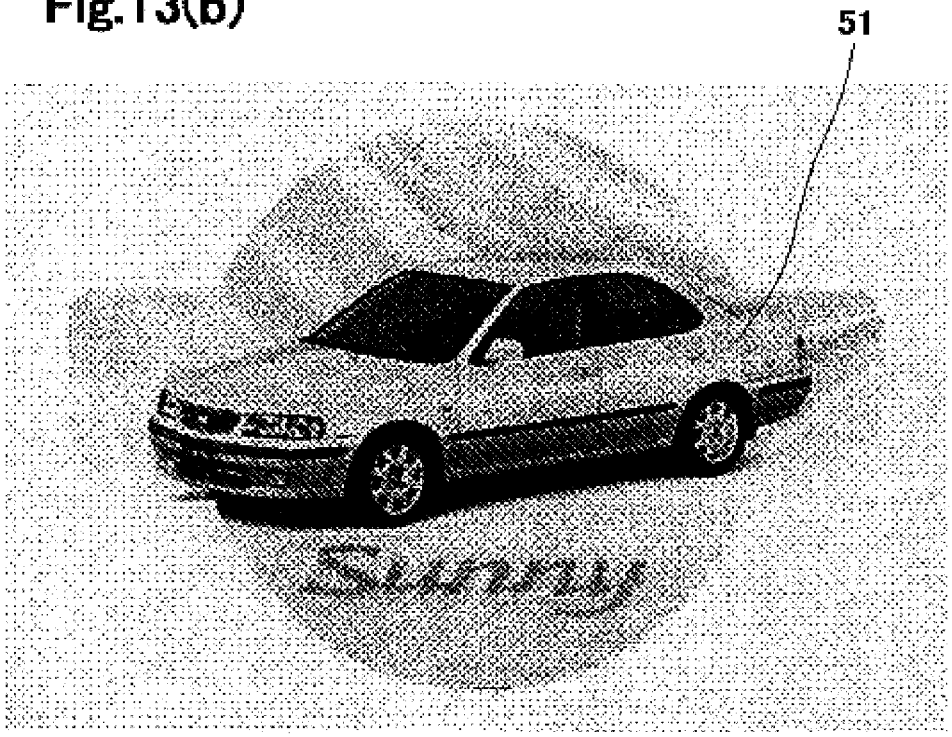

Finally, FIGS. 11 to 13(*b*) show the fifth embodiment.

The printed matter 50 of this embodiment comprises a first layer printed with a thermo-metachromatic ink to give a pattern of bubbles. Small round regions representing the bubbles are devoid of ink and surrounded each with a colored background.

The figure of a flower is printed on the second layer.

The printed matter 50 having also a plastics base film 11 may be a transfer sheet. After transfer of those image prints to a cup 10 or the like, said layers are reversed inside out to expose the first layer.

The bubble-pattern print on the first layer in this printed matter 50 will remain colored within a range of ordinary temperatures so as to hide the second layer having therein the flower image. The small round regions devoid of the ink leave discrete portions of the flower to be visible from outside.

At elevated temperatures, the metachromatic ink will lose color to become transparent so as to render visible the full image of flower.

Replacement of such a normal and partial view of one image with the complete sight thereof taking place in response to change in temperature will give viewers a quiz-like interest.

A virtual example of the fifth embodiment is shown in FIGS. 13(*a*) and 13(*b*). Printed on the first layer are the characters 'NISSAN' and design as the corporate name and trademark of the Nissan Motor Co., Ltd., a Japanese company. The region representing each character of 'NISSAN' is devoid of ink so as to be blank. Printed on the second layer with a thermo-metachromatic ink are the image of an automobile 51 and its other trademark 'Sunny'.

Thus, viewers can see through the void zones 'NISSAN' some portions of that figure, being inspired to have a feeling of curiosity. With ambient temperature raised to a certain level, the metachromatic ink turns to transparent to render visible the automobile image.

In each of the embodiments described above, the printed matter has the print image of the non-metachromatic ink. However in this invention, such a non-changeable image may be replaced with a second thermo-metachromatic ink image printed with a second metachromatic colorant. This colorant will change its normal color to a different color, so that the nature and performance of the described printed matter will not be affected to any unacceptable extent. The second metachromatic colorant may further be replaced with another one that changes its color at different temperatures from the first one, also without seriously affecting the described effect or function of the printed matter.

In summary, the printed matter of the invention is interesting in that different images appear depending on its temperature to afford a special visual or ornamental effect. The principal or certain elected figure remains visible, notwithstanding any change in the temperature, and nevertheless a further figure whose color depends on temperature will be added to the principal figure whereby a novel visual effect is produced.

In one mode of the invention, the background image alters in response to temperature change.

In another mode, temperature change does scarcely cause change in configuration of the figure and merely bring about change in its color, to thereby produce an epoch-making visual effect.

In a further mode, an upper layer printed with a metachromatic ink allows portions of a non-metachromatic image on the underlayer even if the ink stands colored. Viewers of this printed matter will thus be strongly interested to know what figure is hidden by and under the non-meta-chromatic image.

In a still further mode, a non-metachromatic print and a metachromatic print have respective meanings relevant to each other so that the printed matter will inspire an intellectual impression in the viewers' feeling.

The foregoing disclosure of specific embodiments is intended to be illustrative of the broad concepts comprehended by the invention.

What is claimed is:

1. Printed matter comprising:

a first image printed with at least one of first thermo-metachromatic colorants prone to reversible change in color due to change in ambient temperature; and a second image printed with a colorant selected from the group consisting of non-metachromatic colorants and second thermo-metachromatic colorants prone to change in color at temperatures different from those at which the first colorants change their color, wherein one of the first and second images is printed substantially on the whole surface area of the printed matter, and one of the first and second images forms at least one portion of a background for the other image.

2. Printed matter as defined in claim 1, wherein the first image is exposed on an article, with the second image intervening between the first image and the article.

3. Printed matter as defined in claim 1, wherein the thermo-metachromatic colorants forming the first image have the property of altering a colorless state to a colored state or vice versa, depending on change in the ambient temperature.

4. Printed matter as defined in claim 1, wherein the printed matter is of a form selected from the group of transfer sheets and seals and articles that have images thereon transferred from the transfer sheets or seals.

5. Printed matter as defined in claim 1, wherein the first image is printed with at least two colors.

6. Printed matter comprising:

a first image printed with at least one of first thermo-metachromatic colorants prone to reversible change in color due to change in ambient temperature; and a second image printed with a colorant selected from the group consisting of non-metachromatic colorants and second thermo-metachromatic colorants prone to change in color at temperatures different from those at which the first colorants change their color, wherein both the first and second images are line drawings that are of the same configuration at least partially and are superposed one on another at least in part.

7. Printed matter as defined in claim 6, wherein the first image is exposed on an article, with the second image intervening between the first image and the article.

8. Printed matter as defined in claim 6, wherein the thermo-metachromatic colorants forming the first image have the property of altering a colorless state to a colored state or vice versa, depending on change in the ambient temperature.

9. Printed matter as defined in claim 6, wherein the printed matter is of a form selected from the group of transfer sheets and seals and articles that have images thereon transferred from the transfer sheets or seals.

10. Printed matter as defined in claim 6, wherein the first image is printed with at least two colors.

11. Printed matter comprising:

a first image printed with at least one of first thermo-metachromatic colorants prone to reversible change in color due to change in ambient temperature; and a second image printed with a colorant selected from the group consisting of non-metachromatic colorants and second thermo-metachromatic colorants prone to change in color at temperatures different from those at which the first colorants change their color, wherein the first image is superimposed on the second image, wherein the first image has at least one region devoid of the at least one of first thermo-metachromatic colorants so as to expose a part of the second image to be visible from outside.

12. Printed matter as defined in claim 11, wherein the first image is exposed on an article, with the second image intervening between the first image and the article.

13. Printed matter as defined in claim 11, wherein the thermo-metachromatic colorants forming the first image have the property of altering a colorless state to a colored state or vice versa, depending on change in the ambient temperature.

14. Printed matter as defined in claim 11, wherein the printed matter is of a form selected from the group of transfer sheets and seals and articles that have images thereon transferred from the transfer sheets or seals.

15. Printed matter as defined in claim 11, wherein the first image is printed with at least two colors.

16. Printed matter comprising:

a first image printed with at least one of first thermo-metachromatic colorants prone to reversible change in color due to change in ambient temperature; and a second image printed with a colorant selected from the group consisting of non-metachromatic colorants and second thermo-metachromatic colorants prone to change in color at temperatures different from those at which the first colorants change their color, wherein the first image is superimposed on the second image, and the first and second images are of meanings relevant to each other.

17. Printed matter as defined in claim 16, wherein the first image is exposed on an article, with the second image intervening between the first image and the article.

18. Printed matter as defined in claim 16, wherein the thermo-metachromatic colorants forming the first image have the property of altering a colorless state to a colored state or vice versa, depending on change in the ambient temperature.

19. Printed matter as defined in claim 16, wherein the printed matter is of a form selected from the group of transfer sheets and seals and articles that have images thereon transferred from the transfer sheets or seals.

20. Printed matter as defined in claim 16, wherein the first image is printed with at least two colors.

21. Printed matter comprising:

a first image printed with at least one of first thermo-metachromatic colorants prone to reversible change in color due to change in ambient temperature; and a second image printed with a colorant selected from the group consisting of non-metachromatic colorants and second thermo-metachromatic colorants prone to change in color at temperatures different from those at which the first colorants change their color.

* * * * *